US007150626B2

(12) United States Patent
Clauss et al.

(10) Patent No.: US 7,150,626 B2
(45) Date of Patent: Dec. 19, 2006

(54) METHOD FOR OPERATING A COOKING HOB, AND COOKING HOB

(75) Inventors: Stéphane Clauss, Lipsheim (FR); Martin Oberhomburg, Wetter (DE); Sylvia Peter, Kehl (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 50 days.

(21) Appl. No.: 10/533,542

(22) PCT Filed: Oct. 23, 2003

(86) PCT No.: PCT/EP03/11754

§ 371 (c)(1),
(2), (4) Date: May 2, 2005

(87) PCT Pub. No.: WO2004/042283

PCT Pub. Date: May 21, 2004

(65) Prior Publication Data

US 2006/0118100 A1 Jun. 8, 2006

(30) Foreign Application Priority Data

Nov. 2, 2002 (EP) ..... 02024375

(51) Int. Cl.
*F23N 5/20* (2006.01)
*F23N 1/02* (2006.01)
*F24C 3/12* (2006.01)

(52) U.S. Cl. ..... 431/6; 431/12; 126/39 G; 126/39 BA

(58) Field of Classification Search ..... 431/6, 431/12; 126/39 G, 39 BA, 42
See application file for complete search history.

(56) References Cited

U.S. PATENT DOCUMENTS

| | | | | |
|---|---|---|---|---|
| 4,554,438 | A | 11/1985 | Schreder | |
| 4,580,550 | A | 4/1986 | Kristen | |
| 4,697,068 | A | 9/1987 | Schreder | |
| 5,425,353 | A | 6/1995 | Herbert | |
| 6,280,179 | B1 * | 8/2001 | Bird | 431/12 |

FOREIGN PATENT DOCUMENTS

| | | |
|---|---|---|
| DE | 35 35 743 A1 | 4/1987 |
| DE | 41 38 814 C2 | 5/1993 |
| DE | 196 30 031 A1 | 1/1998 |
| EP | 1 188 990 A2 | 3/2002 |

OTHER PUBLICATIONS

International Search Report.

* cited by examiner

*Primary Examiner*—Alfred Basichas
(74) *Attorney, Agent, or Firm*—Russell W. Wamock; Craig J. Loest

(57) ABSTRACT

A gas cooking hob and a method of operating the hob including at least two physical cooking points and at least one electronic control component. A second one of the two cooking points located at a greater distance from the electronic control component than the first cooking point. The first cooking point is rendered inoperational or its calorific output is reduced when a first threshold temperature of the electronic control component is exceeded. The second cooking point is remains operational or its calorific output remains unchanged.

20 Claims, 8 Drawing Sheets

METHOD FOR OPERATING A COOKING HOB, AND COOKING HOB

The present invention relates to a cooking hob, in particular a gas cooking hob and a method for operating the cooking hob with at least two cooking points and with at least one electronic control component, of which cooking points at least a second cooking point is at a greater distance from the electronic component than a first cooking point.

A method for operating a cooking hob is known, in which the gas burners are turned off to protect electronic components of the gas cooking hob from overheating, whenever the temperature of the electronic components exceeds a threshold temperature. The threshold temperature corresponds to the maximum permissible temperature, and when this is exceeded there is the danger of overheating of the electronic components.

The object of the present invention comprises providing a cooking hob, in particular a gas cooking hob, as well as a method for operating a cooking hob, in order to improve its serviceability.

The task of the invention is solved by a method having the features of Claim 1. According to the characterising part of Claim 1 in the method the first cooking point nearest to the electronic component is assigned a threshold temperature independently of the second cooking point.

Whenever the temperature of the electronic component exceeds this threshold temperature, only the nearest first cooking point is rendered inoperational to protect from overheating of the electronic component or respectively its calorific output is reduced. The second cooking point by comparison remains serviceable for a user.

According to the present invention in gas cooking hobs it has proven particularly advantageous if the second cooking point, that is, the second gas burner, remains operational. In this case namely a primary air flow to the second gas burner supports effective cooling of the electronic component. The primary air flow occurs when convection air from the environment is suctioned into the gas supply line leading to the gas burner.

The following embodiments aimed at gas cooking hobs also apply in general similarly for electro-cooking hobs with corresponding cooking points: according to a particular embodiment the threshold temperature can be in a magnitude of ca. 20 K below a permissible maximum temperature. The latter may not be exceeded with a thermal load of the electronic component. The first cooking point is therefore already switched off before the maximum temperature is reached or respectively reduced in its calorific output. In this way despite operation of the further removed cooking point the component temperature does not rise to maximum temperature.

To boost serviceability of the gas cooking hob it is an advantage if the operability or respectively the calorific output of the first cooking point is still made or respectively reset during the cooking hob operation. This means that while other gas burners are in operation, the resetting of the first gas burner takes place. In a particularly simple way in terms of circuit technology the electronic control unit of the gas cooking hob can therefore be assigned a time function element. The time function element prevents resetting of the first gas burner until such time as a preset cooling interval has expired.

The length of the cooling interval can be predetermined as follows: first a variation in time of the component temperature is detected directly after it enters the cooling interval.

On the basis of the detected variation in time the length of the time interval is predetermined.

Alternatively and/or in addition the angle of inclination of the variation in time of the component temperature can also be monitored on an ongoing basis: if the component temperature falls at an angle of inclination, which is greater than a predetermined angle of inclination stored in the control unit, resetting of the first gas burner takes place.

In terms of safety engineering it is particularly advantageous if resetting of the first gas burner takes place as soon as the component temperature again falls below the threshold temperature. In particular the first gas burner can be reset if the component temperature falls below a lower threshold temperature below the threshold temperature. This is advantageous with virtually continuous measuring of the component temperature. With continuous measuring the measured temperature values can fluctuate within a tolerance band about an average component temperature. The lower threshold temperature lies around this tolerance band below the actual threshold temperature. Constant on/off switching of the gas burner is thus prevented if the component temperature moves in the vicinity of the threshold temperature.

It is particularly operation-friendly if before any such exceeding of temperature the calorific output of the first gas burner corresponds to the threshold temperature of the calorific output after any such falling below of threshold temperature. This is easily achievable in particular with so-called fully-electronic gas cooking hobs. With fully-electronic gas cooking hobs the power stage of a cooking point can be stored by electronic control unit. With switching on again of the first gas burner the stored power stage of the first gas burner is automatically reset by means of the electronic control unit.

After successful reduction in calorific output at the cooking point if the component temperature curve does not sink, further measures can be taken to protect from overheating of the electronic component: it is advantageous if the first cooking point is completely switched off.

If the component temperature curve does not sink even after the first gas burner is switched off, in addition the second gas burner can be switched to inoperative or respectively reduced in its calorific output. This measure can be undertaken in a technically simple manner, if the component temperature is still over the threshold temperature after a specific time period.

Similarly to the first gas burner the second gas burner can also be assigned its own second threshold temperature. The latter is above the first threshold temperature. If the component temperature exceeds the second threshold temperature, in addition the second gas burner is rendered inoperational or respectively its calorific output is reduced. This variant is preferred in terms of safety technology, since the second gas burner is actuated only when the assigned threshold temperature is actually exceeded.

The serviceability of the gas cooking hob can be raised further, when its own threshold temperature is assigned in each case to each of the gas burners of the gas cooking hob.

The values of the assigned threshold temperatures rise with increasing distance of the burner from the electronic component. Insofar as the component temperature exceeds one of the threshold temperatures, the assigned gas burner is rendered inoperational or respectively its calorific output is reduced. In the case of a rising component temperature once the temperature drops below the first threshold temperature first the first gas burner is switched off or respectively its calorific output is reduced. The further away gas burners in series are then switched off also or respectively their calorific outputs are reduced. The threshold temperature of the gas burners farthest from the electronic component can be set in the vicinity of the maximum permissible temperature for the electronic component.

Four embodiments of the invention will now be described hereinbelow with reference to the accompanying figures, in which.

Figure 1:
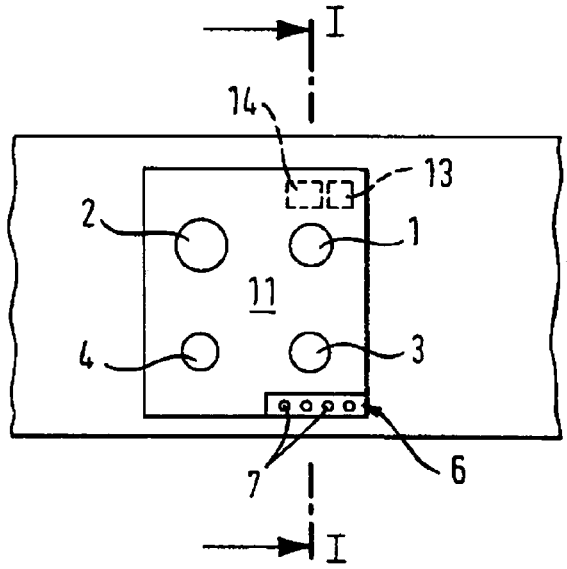
FIG. 1 is a gas cooking hob in a plan view.
Figure 2:
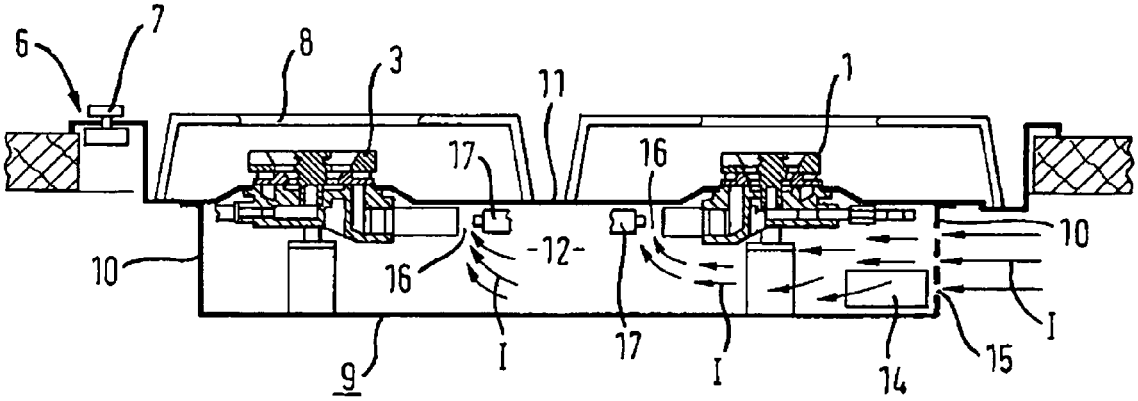
FIG. 2 is a side elevation along line 1—1 of Figure.

FIG. 1 illustrates a gas cooking hob set in a section of a work surface. The gas cooking hob has four gas burners 1, 2, 3, 4. The gas burners are operated by a control knob 7 provided in a front control panel 6. As indicated in FIG. 2, above the gas burner grids 8 are arranged, on which cooking goods containers (not illustrated here) can be set. According to FIG. 2 the gas cooking pan has a floor pan 9 with high side walls 10. Attached to the side walls 10 of the floor pan 9 is a cover plate 11. The cover plate 11 sits with its outer periphery on the work surface 1. The gas burners 1, 2, 3, 4 protrude through assembly openings provided in the cover plate 11. Together with the cover plate 11 the floor pan 9 delimits a trough interior 12, in which are arranged electronic components, such as an ignition device 13 or a control unit 14 for the gas burner.

Built into the rear side wall 10 of the floor pan 9 are primary air openings 15. Convection air flows through the latter into the trough interior 12. The convection air serves as primary air supply for air suction areas 16 on gas nozzles 17 of the gas burner. A flow path of convection air is indicated in FIG. 2 by means of arrows I. For the electronic components 13, 14 to be cooled they are arranged in the flow path I.

Figure 3:
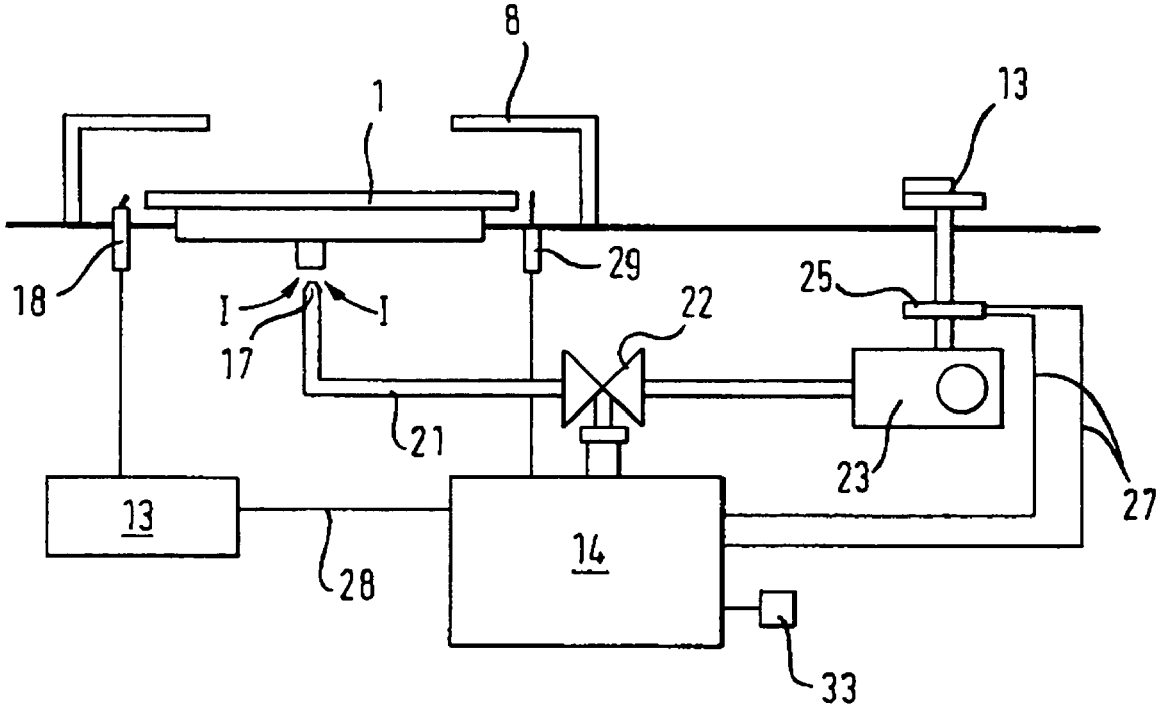
FIG. 3 is a block diagram of the gas cooking hob according to the first embodiment.

In the block diagram of FIG. 3 the functional connection between the components 13, 14 with the gas burner 1 is shown. The other gas burners 2 to 4 are connected identically to the components 13, 14. Accordingly the gas burner 1 is supplied with gas via a gas supply line 21. In the gas supply line 21 an electromagnetic safety valve 22 is arranged, which is opened or closed by the electronic control unit 14. The gas volume flow required for desired burner heat capacity in the gas supply line 21 can be adjusted by a gas tap 23. The gas tap 23 is to be actuated by the control knob 13. The control knob 13 is also coupled to a signal emitter 25, which is in signal connection via lines 27 with the electronic control unit 14.

A thermoelement 29, which detects the presence of a flame on the gas burner 1, is assigned to the gas burner 1 for flame monitoring. The electronic control unit 14 is also connected by signal via a line 29 to the ignition device 13. The latter controls an ignition electrode 18 for the purpose of igniting a flame on the gas burner 1.

To start up the gas burner 1 a pressure and/or rotary motion is exerted on the control knob 13. This effectively generates corresponding signals from the signal emitter 25 and sends them via the lines 27 to the electronic control unit 14. The electronic control unit 14 detects the signals of the signal emitter 25 and controls the ignition device 13 accordingly. At this point their ignition electrode 18 ignites a flame on the gas burner 1. At the same time the electronic control unit 14 contacts the interim closed safety valve 22 with a current from an external source. Via the current from an external source the safety valve 22 is opened and therefore also the gas supply line 3 to the gas burner 1. On completion of gas ignition on the gas burner 1 the thermoelement 27 is heated by the flame of the gas burner 1. The thermocurrent thus generated on the thermoelement 27 assumes the function of the current from an external source and holds the safety valve 22 open in its place. After extinguishing of flames on the gas burner 1 the thermoelement cools off, whereby no further thermocurrent is produced. The result is that the electronic control unit 14 closes the safety valve 22 and the gas supply line 21 to the gas burner 1 is blocked.

According to the present invention in FIG. 3 the electronic control unit 14 is connected to a temperature sensor 33. The temperature sensor 33 detects a temperature $T_K$ in the region of the electronic components 13, 14. The detected temperature $T_K$ is compared to threshold temperature $T_1$, $T_2$, $T_3$, $T_4$ stored in the control unit 14.

Figure 4:
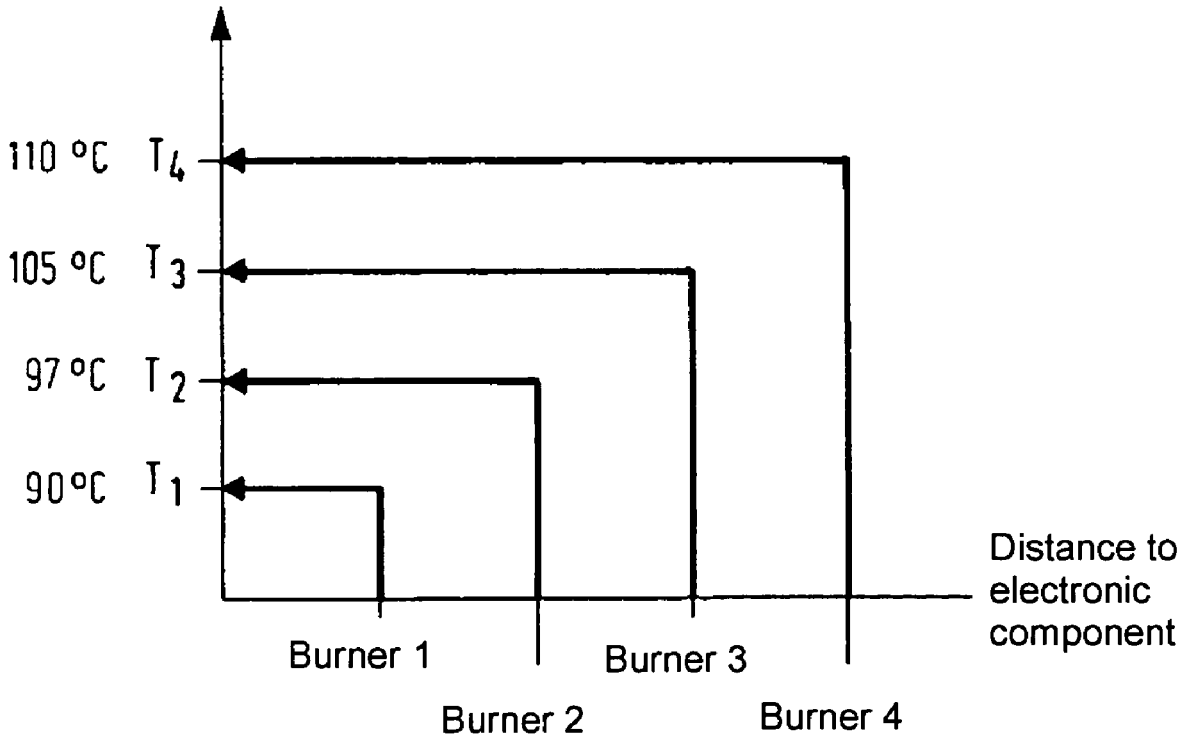
FIG. 4 is a diagram stored in an electronic control unit of the gas cooking hob.

According to the diagram from FIG. 4 each of the threshold temperatures $T_1$, $T_2$, $T_3$, $T_4$ is assigned to one of the four gas burners 1, 2, 3, 4. From the diagram of FIG. 4 it emerges that the values of the stored threshold temperatures $T_1$, $T_2$, $T_3$, $T_4$ increase with increasing distance of the gas burner from the electronic components 13, 14. Accordingly a lower threshold temperature $T_1$ of 90° C. is assigned to the gas burner 1 nearest to the electronic components 13, 14.

Assigned to the gas burner 4 farthest away from the electronic components 13, 14 is an upper threshold temperature $T_4$ of 110°. The upper threshold temperature $T_4$ is approximately in a range which is reached at a maximum permissible thermal load of the components 13, 14.

Figure 5:
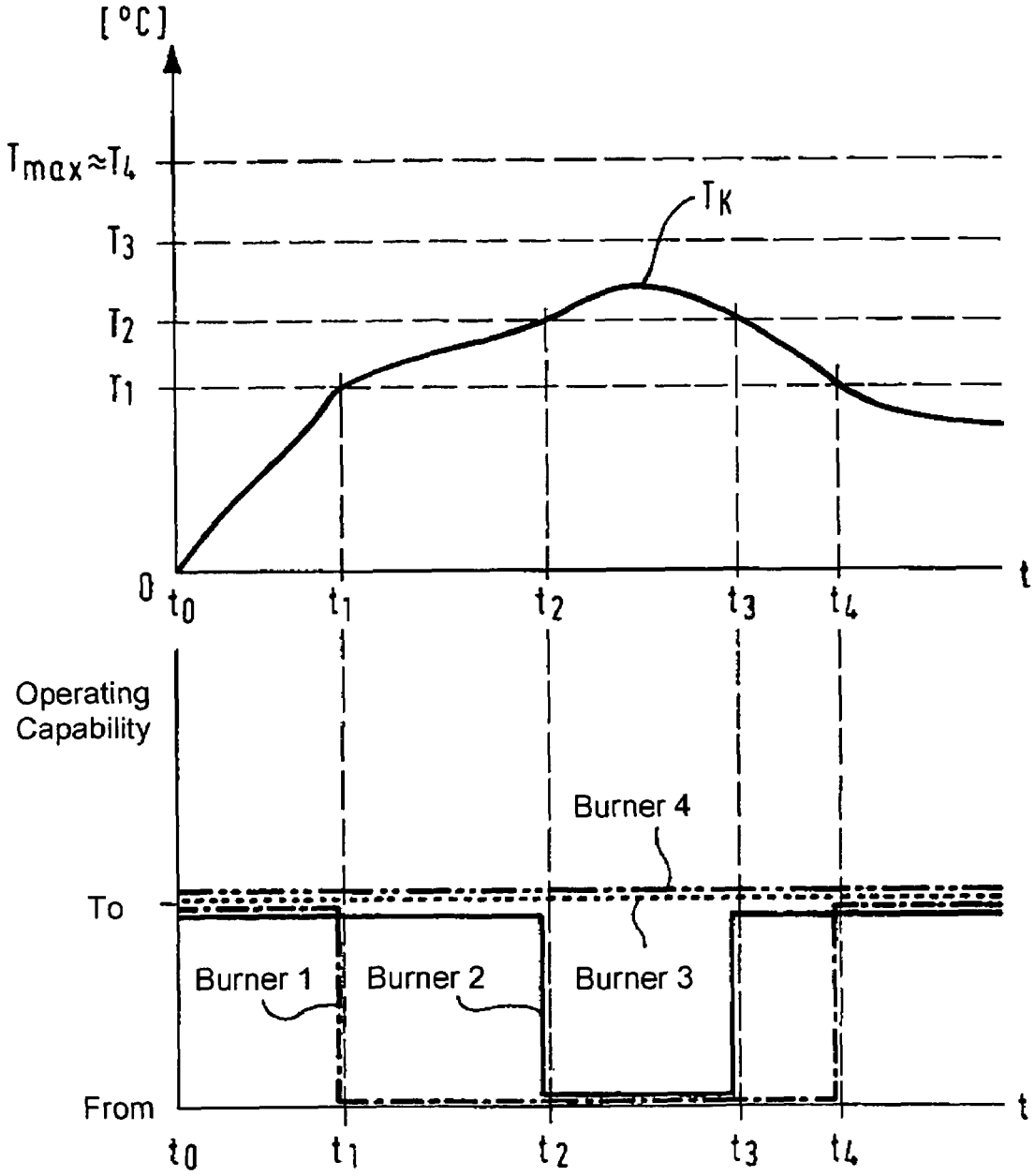
FIG. 5 is a temperature and operability diagram according to the first embodiment.

A variation in time of the temperature $T_K$ of the electronic components 13, 14 measured by temperature sensor 33 is shown in the temperature diagram of FIG. 5: accordingly, the component temperature $T_K$ first rises constantly to the beginning of the burner operation after the time point $t_0$ until the first threshold temperature $T_1$ is exceeded. This is assigned to the first gas burner 1. In this case the safety valve 22 is triggered and closed in the gas supply line 21 to the first gas burner 1 by the electronic control unit 14. The first gas burner 1 is thus rendered inoperational from the time point $t_1$, as is evident from the operability diagram of FIG. 5 below. Because of switching off the first gas burner 1 the component temperature $T_K$ rises further after time point $t_1$, less strongly, until at time point $t_2$ the second threshold temperature $T_2$ is exceeded. This is assigned to the second gas burner 2. Accordingly at time point $t_2$ the electronic control unit 14 closes the safety valve 22 of the second gas burner 2. As a result after the time point $t_2$ the component temperature $T_K$ runs below the threshold temperatures $T_3$, $T_4$ of both remaining gas burners 3, 4. The gas burners 3, 4 therefore remain operational. At time point $t_3$ the component temperature $T_K$ again drops below the second threshold temperature $T_2$. The electronic control unit 14 therefore again releases the safety valve 22 of the second gas burner 2 at time point $t_3$. The second gas burner 2 can therefore be brought back into operation with corresponding actuation of the assigned control knob 13. At time point $t_4$ the component temperature $T_K$ also drops below the first threshold temperature $T_1$. The electronic control unit 14 therefore also again releases the safety valve 22 of the first gas burner 1 from time point $t_4$.

Figure 6:
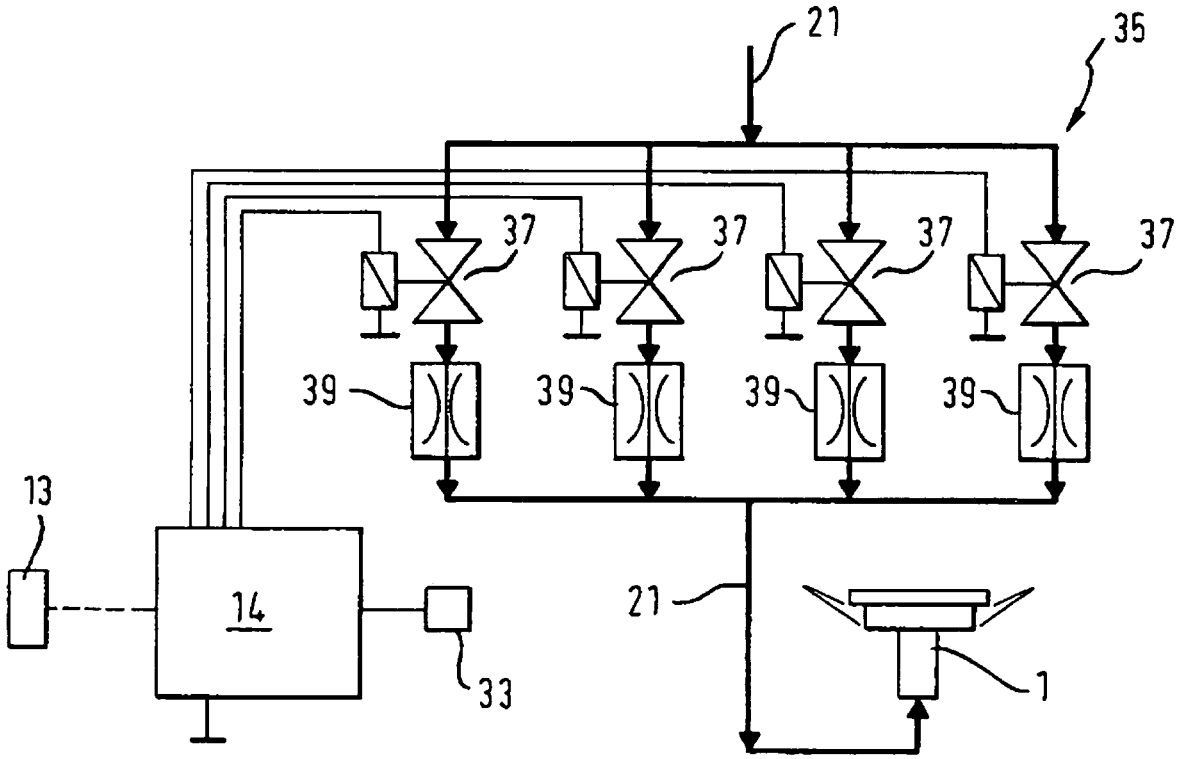
FIG. 6 is a block diagram as per FIG. 3 according to the second embodiment.
Figure 7:
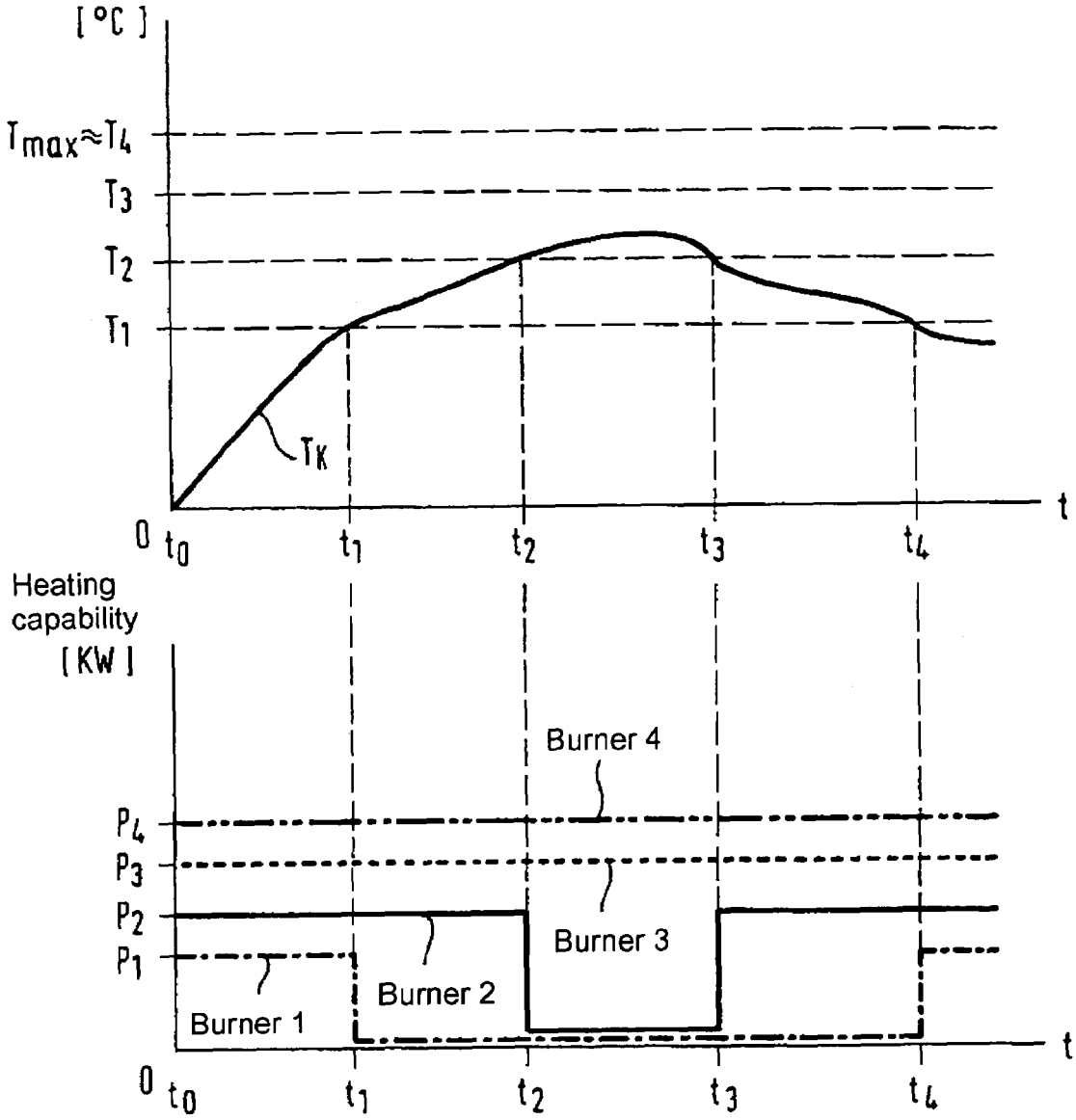
FIG. 7 is a temperature and calorific output diagram according to the second embodiment.

In the second embodiment of FIGS. 6 and 7 power setting of the gas burners 1, 2, 3, 4 takes place not by means of has taps 23, but via the control valve arrays 35. The gas control valve arrays 35 are connected between the electronic control unit 14 and each of the four gas burners 1, 2, 3, 4.

For illustration in FIG. 7 only the gas control valve array 35 connected in between the gas burner 1 and the control unit 14 is shown. The latter is arranged in the gas supply line 21 and has four parallel partial gas lines, through which in each case a partial gas current flows. An electromagnetic control valve 37 with downstream throttle 39 is arranged in each of the partial gas lines. Their throttle diameters can be distinguished from one another. Downstream of the throttles 39 the partial gas lines are recombined in the gas supply line 21. Depending on the power stage adjusted by the operator the control unit 14 opens one or more of the control valves 37 in the parallel partial gas lines. The magnitude of the gas flow exiting from the gas control valve array 35 to the gas burner 1 therefore matches the number of opened control valves 37.

In FIG. 7 gas cooking hob operation according to the second embodiment is shown by means of a temperature and calorific output diagram. According to the lower calorific output diagram at time point $t_0$ all four gas burners 1, 2, 3, 4 are in operation at different calorific outputs $P_1$, $P_2$, $P_3$, $P_4$. The component temperature $T_K$ rises constantly after time point $t_0$. At time point $t_1$, the component temperature $T_K$ exceeds the first threshold temperature T. The four control valves 37 of the first gas burner 1 are accordingly closed from the time point $t_1$.

At the same time the control unit 14 stores the settings of the control valves 37 of the gas burner 1 at time point $t_1$. At time point $t_2$ the component temperature $T_K$ exceeds the second threshold temperature $T_2$. The electronic control unit 14 accordingly closes all control valves 37 of the second gas burner 2 and at the same time stores their settings. At time point $t_3$ the component temperature $T_K$ however falls below the second threshold temperature $T_2$. The electronic control unit 14 therefore controls the control valves 37 of the second gas burner 2 according to their stored settings. The second gas burner 2 is therefore operated again from time point $t_3$ with its calorific output $P_2$. In similar fashion at time point $t_4$ also the first gas burner 1 is put back into operation.

Figure 8:
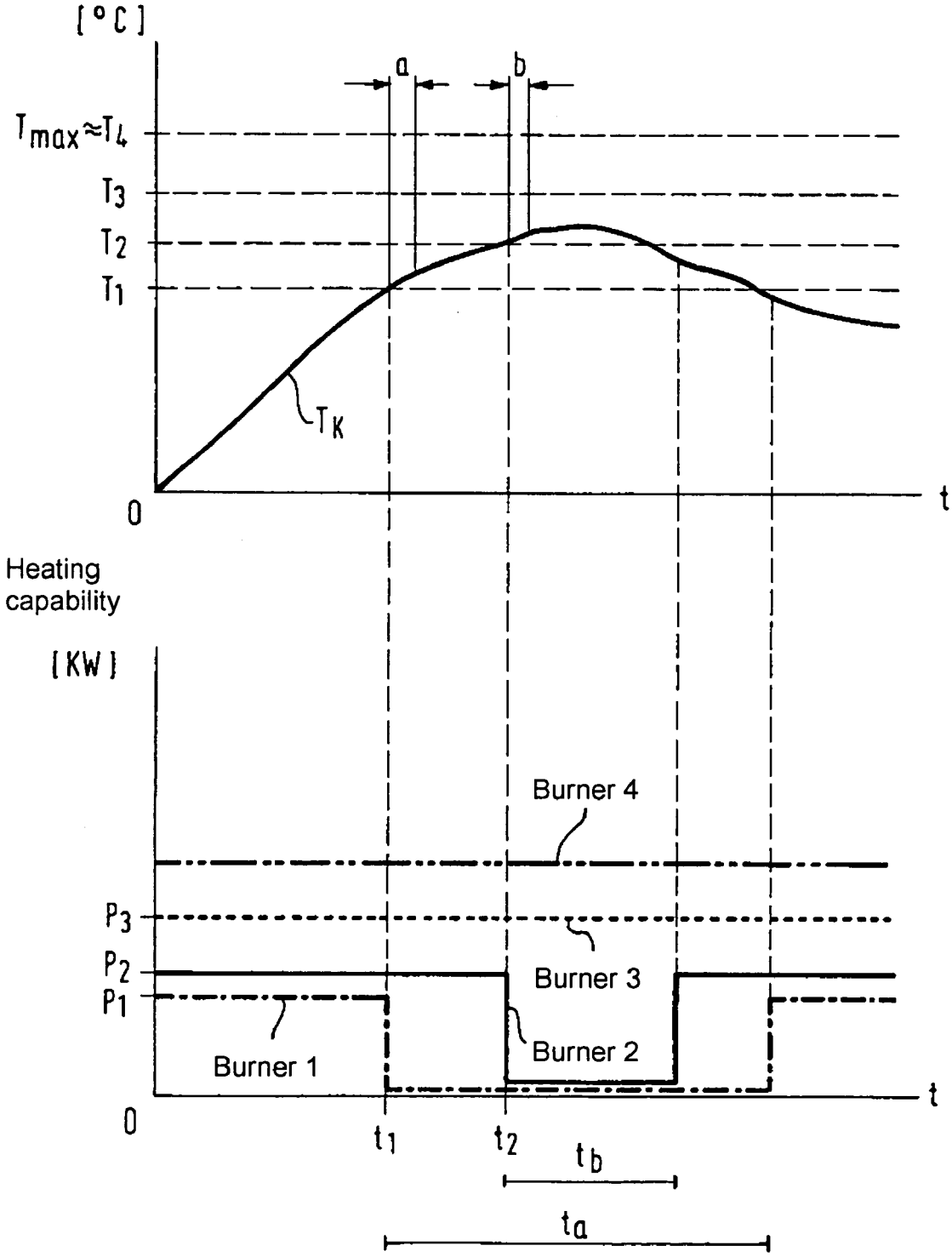
FIG. 8 is a temperature and calorific output diagram according to the third embodiment.

In FIG. 8 a temperature und calorific output diagram is shown according to the third embodiment. The structure of the gas cooking hob of the third embodiment is similar to the gas cooking hob of the second embodiment. As shown in the calorific output diagram of FIG. 8, directly after the temperature drops below one of the threshold temperatures $T_1$, $T_2$, $T_3$, $T_4$ a cooling interval $t_a$, $t_b$ for the switched off gas burner is previously determined. To determine the length of the cooling interval $t_a$ the component temperature $T_K$ is first determined in a time span a of the curve trajectory. The time span a begins directly after the component temperature $T_K$ has exceeded the threshold temperature $T_1$. By way of the curve trajectory of the component temperature $T_K$ determined in the time span a the electronic control unit 14 determines the length of the cooling interval $t_a$ for the gas burner 1. On expiry of the cooling interval $t_a$ the first gas burner 1 is again operated with its stored calorific output $P_1$. Likewise the length of the time interval $t_b$ for the second gas burner 2 is determined, after the component temperature $T_K$ has exceeded the second threshold temperature $T_2$.

Figure 9:
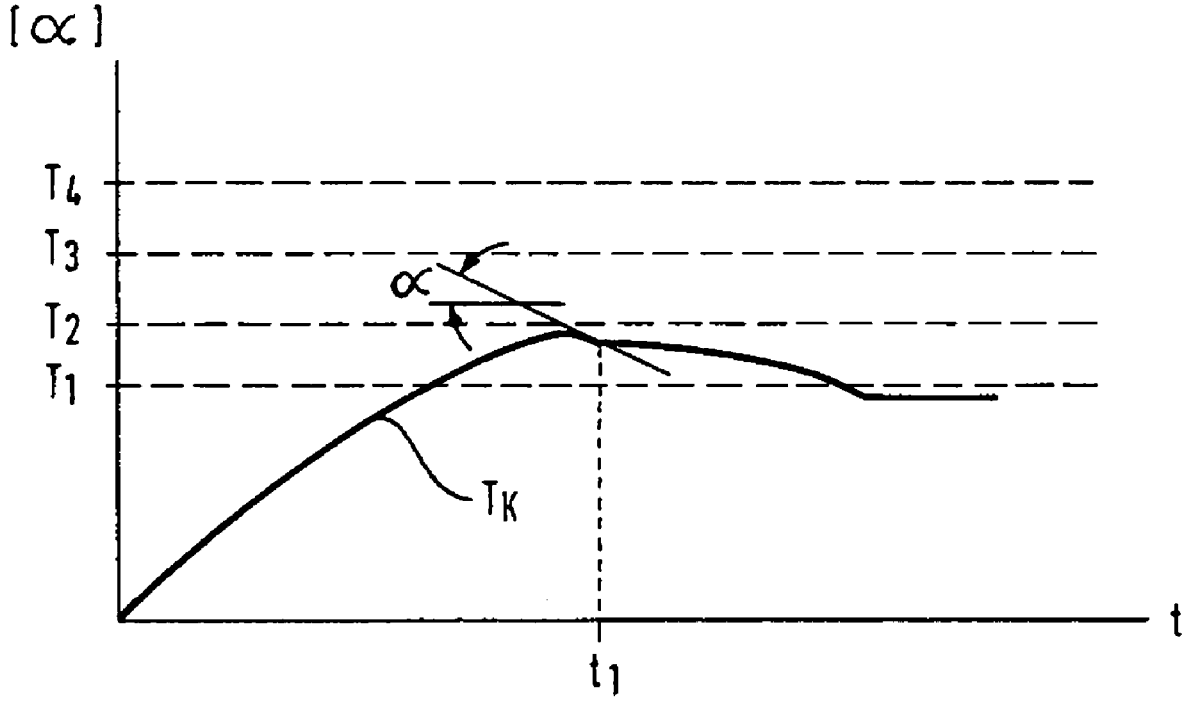
FIG. 9 is a temperature diagram according to the fourth embodiment.

Alternatively or in addition the gas burner switched inoperational can also then be rendered operational again whenever the component temperature $T_K$ falls at an angle of inclination $\alpha$, which is greater than a preset angle of inclination. The preset angle of inclination is stored in the control unit 14. According to the temperature diagram of FIG. 9 at the time point $t_1$ the angle of inclination $\alpha$ is detected. The detected angle of inclination $\alpha$ is greater than the stored angle of inclination. As a result the control unit 14 renders the first gas burner 1 operational again immediately, even before the component temperature $T_K$ has fallen back to below the uncritical threshold temperature $T_1$.

What is claimed is:

1. A method for operating a gas cooking hob, the cooking hob including at least two cooking points and at least one electronic control component, of which at least the second cooking point is further away from the electronic control component than the first cooking point, comprising:

sensing the temperature of the electronic control component;

one of rendering the first cooking point inoperational or reducing the calorific output of said first cooking point when a first predetermined threshold temperature is sensed; and one of continuing to operate the second cooking point or maintaining said second cooking point calorific output unchanged when said first predetermined threshold temperature is sensed.

2. The method according to claim 1, including said electronic control component has a predetermined maximum permissible thermal load and said first predetermined threshold temperature is in a magnitude of about ca. 20 K below a temperature range reached at said predetermined maximum permissible thermal load.

3. The method according to claim 1, including resetting one of the operability or the calorific output of said first cooking point during operation of the cooking hob.

4. The method according to claim 3, including said resetting of one of the operability or the calorific output of said first cooking point during operation of the cooking hob occurs following the expiration of a preset cooling interval.

5. The method according to claim 4, including presetting the length of said preset cooling interval by the variation in time of the temperature of said electronic control component directly after said electronic control component enters said cooling interval.

6. The method according to claim 5, including presetting an angle of inclination of said variation in time of said temperature of said electronic control component and resetting one of said operability or said calorific output of said first cooking point when said variation in time of said temperature of said electronic control component falls at an angle of inclination greater than said preset angle of inclination.

7. The method according to claim 4, including a second predetermined threshold temperature lower than said first predetermined threshold temperature and resetting said one of said operability or said calorific output of said first cooking point when said temperature of said electronic control component falls below said second predetermined threshold temperature.

8. The method according to claim 4, including measuring said calorific output of said first cooking point and resetting said first cooking point to the measured calorific output before said temperature of said electronic control component before said first predetermined threshold temperature is exceeded.

9. The method according to claim 1, including reducing said calorific output of said first cooking point when said first predetermined threshold temperature is sensed and then switching off said first cooking point if said temperature of said electronic control component still exceeds said first predetermined threshold temperature.

10. The method according to claim 1, including additionally one of rendering said second cooking point inoperational or reducing the calorific output of said second cooking point if said temperature of said electronic control component still exceeds said first predetermined threshold temperature after a predetermined time period.

11. The method according to claim 1, including a second predetermined threshold temperature which exceeds said first predetermined threshold temperature and including additionally one of rendering said second cooking point inoperational or reducing said calorific output of said second cooking point if said temperature of said electronic control component exceeds said second predetermined threshold temperature.

12. The method according to claim 1, including a plurality of stored predetermined threshold temperatures and including one of rendering one of said cooking points inoperational or reducing said calorific output of said cooking point if said temperature of said electronic control component exceeds at least one of said predetermined threshold temperatures.

13. The method according to claim 12, including a plurality of cooking points and assigning each of said plurality of stored predetermined threshold temperatures to one of said cooking points and increasing the value of said stored predetermined threshold temperatures in accordance with the distance of each said cooking point from said electronic control component.

14. The method according to claim 1, including directing a primary air flow to said plurality of cooking points and arranging said electronic control component in said primary air flow for cooling said electronic control component.

15. A gas cooking hob, comprising:

at least two cooking points;

at least one electronic control component with at least a second cooking point located further away from said electronic control component than a first cooking point;

a sensor for sensing the temperature of said electronic control component;

said electronic control component one of renders said first cooking point inoperational or reduces the calorific output of said first cooking point when said sensor senses a first predetermined threshold temperature; and said electronic control component one of continues to operate said second cooking point or maintains said second cooking point calorific output unchanged when said sensor senses said first predetermined threshold temperature.

16. The gas cooking hob according to claim 15, including said electronic control component resets one of the operability or the calorific output of said first cooking point during operation of the cooking hob.

17. The gas cooking hob according to claim 16, including said electronic control component resets one of said operability or said calorific output of said first cooking point during operation of said cooking hob following the expiration of a preset cooling interval.

18. The gas cooking hob according to claim 17, including a second predetermined threshold temperature lower than said first predetermined threshold temperature and said electronic control component resets said one of said operability or said calorific output of said first cooking point when said temperature of said electronic control component falls below said second predetermined threshold temperature.

19. The gas cooking hob according to claim 15, including said electronic control component reduces said calorific output of said first cooking point when said first predetermined threshold temperature is sensed and then switches off said first cooking point if said temperature of said electronic control component still exceeds said first predetermined threshold temperature.

20. The gas cooking hob according to claim 15, including a plurality of stored predetermined threshold temperatures and including said electronic control component one of renders one of said cooking points inoperational or reduces said calorific output of said cooking point if said temperature of said electronic control component exceeds at least one of said predetermined threshold temperatures and assigning each of said plurality of stored predetermined threshold temperatures to one of said cooking points and increasing the value of said stored predetermined threshold temperatures in accordance with the distance of each said cooking point from said electronic control component.

* * * * *